United States Patent [19]

Derckx

[11] Patent Number: 4,459,792

[45] Date of Patent: Jul. 17, 1984

[54] DEVICE FOR TWISTING A PACKING WRAPPING

[76] Inventor: Henricus A. J. M. Derckx, St. Antoniusstraat 31, Weert, Netherlands

[21] Appl. No.: 262,888

[22] Filed: May 13, 1981

[51] Int. Cl.[3] ..... B65B 7/12

[52] U.S. Cl. ..... 53/370

[58] Field of Search ..... 53/370, 594, 378, 227

[56] References Cited

U.S. PATENT DOCUMENTS

| | | | |
|---|---|---|---|
| 1,807,981 | 6/1931 | Haas | 53/370 |
| 2,744,370 | 5/1956 | Seragnoli | 53/370 X |
| 3,272,152 | 9/1966 | Williams | 53/594 X |
| 3,968,627 | 7/1976 | Seragnoli | 53/370 |
| 4,159,612 | 7/1979 | Johnson et al. | 53/594 |

FOREIGN PATENT DOCUMENTS

| | | | |
|---|---|---|---|
| 36282 | 10/1981 | European Pat. Off. | 53/594 |

*Primary Examiner*—Horace M. Culver

*Attorney, Agent, or Firm*—Beveridge, DeGrandi & Kline

[57] ABSTRACT

Devices for twisting the extremities of a wrapping around for example a lollipop produced by high speed production machines often have long levers which are necessary to allow the stick of the lollipop to be supplied and discharged to and from the pairs of twisting claws. This results in high centrifugal forces on those levers. The invention abolishes this drawback by spacing the levers of the pair of claws in question outside the axis of rotation of the device. Further improvements can be reached by providing a counter mass.

3 Claims, 2 Drawing Figures

DEVICE FOR TWISTING A PACKING WRAPPING

Figure 1:
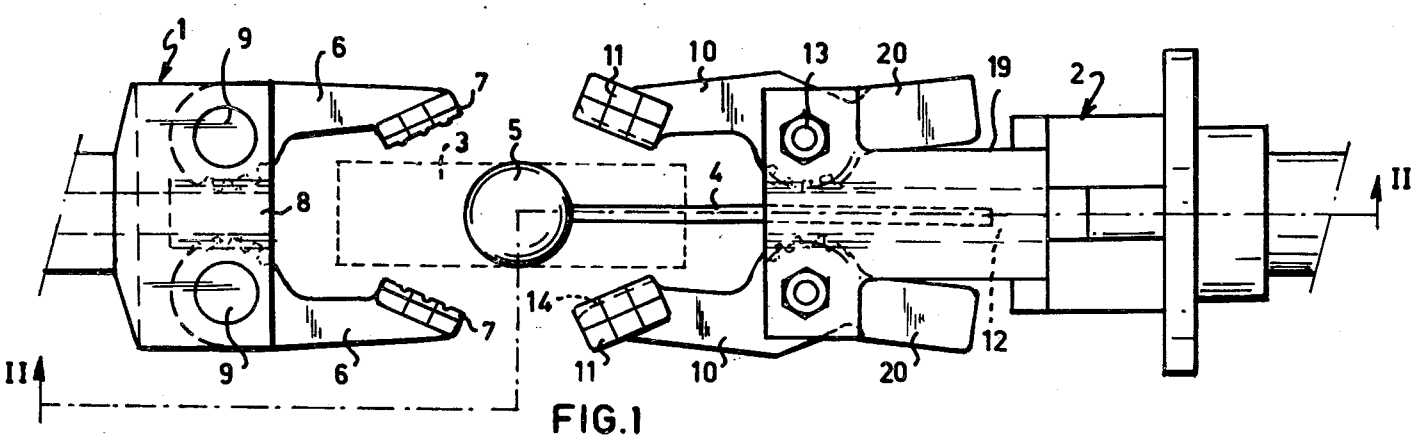

The invention relates to a device for twisting the extremities of a packing wrapping consisting of a member for supplying and discharging objects about which the packing wrapping has to be twisted to pairs of twisting claws, said pairs of twisting claws being mounted hingedly about levers to oppositely rotating heads and having teeth which engage toothed racks slidably mounted in the heads.

A similar device is known from Dutch patent specification No. 120 483. The twisting claws in this known device can make three, three and a half as well as four revolutions. This is possible because of the symmetry of the twisting claws. The number of revolutions for these claws must always be a multiple of half a revolution. This known device is very well suitable for handling substantially spheroidal objects. But the device certainly is not suitable for handling objects which are not substantially spheroidal, but are for instance provided with a projecting stick, as is the case when handling lollipops. Making the known device suitable would mean that the hinged joints of one of the pairs of twisting claws would have to be disposed at a far larger distance of the spheroidal portion of the object in question. This requires long levers, which has high centrifugal forces in result. Consequently, it is nearly impossible to obtain a device whose number of revolutions is sufficient for keeping up with the high production rate of modern machines for the production of lollipops.

The invention aims at providing an improvement of this. According to the invention this has been achieved, in that one of the pairs of claws is adapted to receive a stick attached to the object. In practice this can be attained in that the levers of the pair of claws in question are spaced outside the axis of rotation in such a way that they can let the stick pass to the recesses applied in the claws.

The device can then be adjusted in such a way that the pair of claws in question in each wrapping cycle makes three and a half revolution with the object and half a revolution without the object. Within the scope of the claims it is also possible, however, to start from three revolutions per cycle. The head of the pair of claws in question may then consist of a flange portion for guiding a steering rod for the toothed rack, and a bridge portion and a jib portion in balance with regard to each other. For further balancing the devive according to the invention also the feature is proposed that the levers of the pair of twisting claws are provided with a counter mass beyond the hinged joint of the head.

The invention will be illustrated hereinunder with the aid of the drawing, in which by way of example an embodiment of a device according to the invention is shown. In the drawing FIG. 1 shows a top view and FIG. 2 shows a side view, partially in cross-section, according to the line II—II of FIG. 1.

Figure 2:
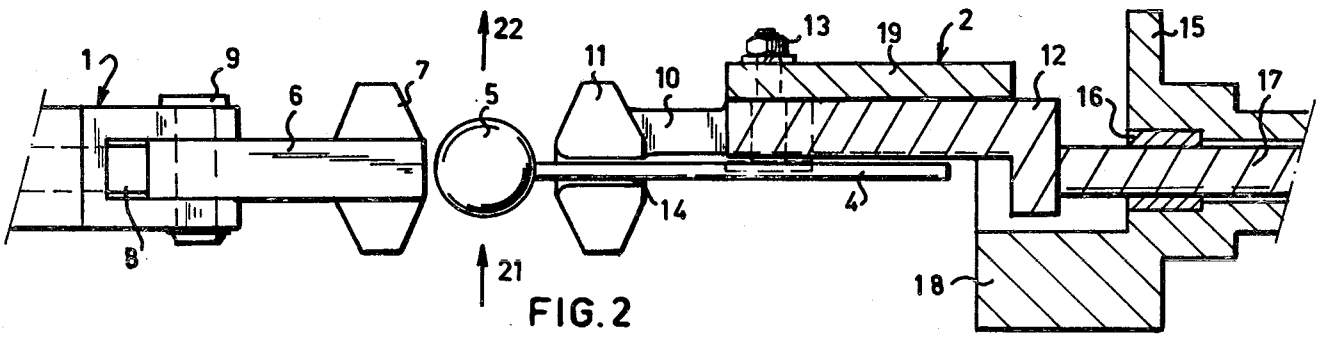

The device shown in the drawing consists of two heads 1 and 2 which rotate in opposite directions for twisting the extremities of a packing wrapping 3 shown by dotted lines in FIG. 1, so that an object 5 provided with a stick 4, such as a lollipop, can efficiently be provided with a packing having an attractive appearance.

The left-hand head 1 in the drawing is provided with hinged levers 6 which at their free ends have the appearance of a claw 7. The hinging of these levers is effected in a known fashion in that a toothed rack 8 is movable in the head in axial direction of the head. The teeth of this toothed rack 8 engage teeth applied to the circular rear end of the levers 6 positioned about the pins 9. Because of safety it is necessary that the claws are closed by a spring pressure and are opened with force.

The right-hand head 2 in the drawing is provided with hinged levers 10 which at their free ends have the appearance of a claw 11. The hinging of these levers is effected by a stepped toothed rack 12 which engages teeth applied to the rear ends of the levers 10 positioned about the screwed connections 13.

The special feature of the right-hand head 2 with regard to the left-hand head 1 now is that though the lever pairs 10 and 6, resp. are equally short, the central axis of the stick nevertheless can be taken into and from the central axis of rotation. This has been achieved by designing the head 2 in such a way that the lever pair 10 is sufficiently spaced from the axis of rotation of this head 2, and by providing the claws 11 with for instance a semicircular recess 14.

The head 2 consists of a cylindrical flange portion 15 with a guide bush 16 for guiding a stearing rod 17 for the toothed rack 12. The flange portion 15 is integral with a bridge portion 18 which in its turn is integral with a jib 19 which supports the levers 10 by means of the screwed connections 13. For balancing all this the jib 19 is positioned preferably diametrally opposite the bridge portion 18. As the jib must be relatively long and wide, the bridge portion is therefore of a proportionally thick construction. The jib 19 may also be fitted out with edges (not shown) dropping over a short distance for guiding the toothed rack 12.

In order to limit also the centrifugal forces on the metal claws 11 to a minimum, the levers 10 may continue to beyond the screwed connections 13 in order to constitute balancing masses 20. The claws 7 of the left-hand head 1 are made of plastic because they need not be heated and are therefore not subject to high centrifugal forces. The claws 11 are made of metal, so that they can be heated in a way not relevant.

The above described device operates in the following way: The object 4/5 and the packing wrapping 3 arrive in the pairs of claws 6 and 7 by movement in the direction of arrow 21. In order to make the twisting of the packing wrapping possible, the object remains at rest for a part of the cycle of the device, for instance for three and a half revolutions of head 2. The lollipop is retained by a device which is driven by a Malthezer cross. In consequence the device moves 120° of a 360° cycle and is at rest for 240°. The head 2 rotates during this stationary period 240/360° for four revolutions. By selecting other ratios of the movement of the rest of the device which retains the lollipop and the number of revolutions of head 2, the outcome is different but the principle remains the same. After twisting, the object moves further in the direction of arrow 22 of FIG. 2. As also stick 4 has to move, it is necessary that the head 2 has rotated 180° when the packed object leaves the claws again. Modern lollipop production machines have a production of about 300 pieces per minute, so that the head 2 must have a number of revolutions of about 1200 revolutions per minute. That is why it is of such great importance that the centrifugal forces be controlled.

It is remarked that the scope of the claims also includes other embodiments than shown in the drawing.

In particular with respect to the claims it is not relevant how the object and the packing are introduced into and discharged from the device. Other applications than lollipops are conceivable and the packing wrapping may also be of different materials, such as a folded piece of paper, a sandwich, a piece of paper both under and over the object, and a sachet, a kind of triangular bag.

I claim:

1. In a device for wrapping a piece of sheet material about an object having a stick extending therefrom, said device including first and second pairs of levers adapted for receiving the object with the piece of sheet material folded thereabout, each lever including a toothed portion and a claw portion having a face surface, each claw portion cooperating with the claw portion of the other lever of its pair for gripping the piece of sheet material to hold the sheet material with the object therein and with the stick extending from the sheet material; first and second oppositely rotatable heads; first and second means hingedly mounting said first and second pairs of levers to said first and second rotatable heads respectively; first and second toothed racks slidably mounted in said first and second rotatable heads respectively, each toothed rack longitudinally slidably movable in its respective rotatable head, the teeth of each toothed rack cooperating with the toothed portions of the associated pair of levers for pivoting the levers to bring the claw portions thereof toward each other, to a gripping position in which the face surface of each claw portion lies in a plane substantially parallel to the direction of slidable movement of the associated toothed rack with the face surfaces of the claw portions of each pair of levers abutting each other to cause the claw portions to grip the piece of sheet material, and to bring the claw portions thereof away from each other, to cause the claw portions to release the piece of sheet material, the claw portions of one of said pairs of levers having a recess adapted to permit passage of the stick therethrough; and means for slidably moving said toothed racks within said rotatable heads, the improvement in which each lever of said one of said pairs of levers includes an offset portion coupling the claw portion and the toothed portion thereof, said offset portion and said toothed portion being offset from the axis of rotation of the associated head in a direction substantially parallel to the plane of the associated claw portion when that claw portion is in the gripping position and substantially normal to the direction of slidable movement of the associated toothed rack, to permit positioning of the stick in said axis of rotation adjacent said offset portion.

2. In the device of claim 1, the further improvement in which each lever of said one of said pairs of levers includes a counterbalancing mass on the side of the toothed portion thereof opposite the claw portion thereof.

3. In the device of claim 1, the further improvement in which the rotatable head associated with said one of said pairs of levers includes a flange portion for guiding the means slidably moving the associated rack, a bridge portion, and a jib portion, said bridge portion and said jib portion being offset from said axis of rotation and sized to be balanced with respect to each other.

* * * * *